US007293442B1

(12) United States Patent
Ghiran et al.

(10) Patent No.: US 7,293,442 B1
(45) Date of Patent: Nov. 13, 2007

(54) METHOD FOR HYDROFORMING A RING-SHAPED TUBULAR STRUCTURE

(75) Inventors: Mike M. Ghiran, Lake Orion, MI (US); Sanjay M. Shah, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/690,941

(22) Filed: Mar. 26, 2007

(51) Int. Cl.
*B21D 26/02* (2006.01)
*B21D 28/28* (2006.01)

(52) U.S. Cl. ..... 72/55; 72/58; 72/62

(58) Field of Classification Search ..... 72/55, 72/56, 58, 61, 62
See application file for complete search history.

(56) References Cited

U.S. PATENT DOCUMENTS 5,799,524 A * 9/1998 Schafer et al. ..... 72/55
5,884,722 A * 3/1999 Durand et al. ..... 180/312
5,899,498 A * 5/1999 Horton ..... 280/781
5,941,112 A 8/1999 Ghiran et al.
6,098,437 A * 8/2000 Kocer et al. ..... 72/55
6,442,820 B1 * 9/2002 Mason ..... 29/421.1
6,505,389 B2 * 1/2003 Manson et al. ..... 29/421.1
6,654,995 B1 12/2003 Wang et al.
6,658,908 B1 12/2003 Ghiran et al.

* cited by examiner

*Primary Examiner*—David B Jones

(57) ABSTRACT

A method is provided for hydroforming a ring-shaped tubular structure such as a door opening for a vehicle body. The method includes providing a ring-shaped tubular blank having a hollow sealed interior, capturing the ring shaped tubular blank in a hydroforming die cavity, piercing the ring shaped tubular blank with a hollow punch, and introducing pressurized fluid through the hollow punch into the hollow sealed interior to expand the tubular structure to conform with the shape of the hydroforming die cavity and thereby hydroform the ring-shaped tubular structure.

18 Claims, 4 Drawing Sheets

METHOD FOR HYDROFORMING A RING-SHAPED TUBULAR STRUCTURE

FIELD OF THE INVENTION

The present invention relates to a method for hydroforming a ring-shaped tubular structure.

BACKGROUND OF THE INVENTION

It is known in the manufacture of motor vehicles to hydroform tubular structures such as roof rails and frame rails that are made from lengths of tube having open ends. The length of tube is captured with the die cavity of a hydroforming die, seals are applied to seal the open ends of the tube, and pressurized fluid is introduced through the tube seals to expand the tube into a shape defined by the die cavity.

It would be desirable to enable improvements in the manufacture and hydroforming of ring-shaped structures of the type that are used in vehicle body applications such as radiator supports, engine cradles, and door openings for the side doors and rear hatch closures.

SUMMARY OF THE INVENTION

A method is provided for hydroforming a ring-shaped tubular structure such as a door opening for a vehicle body. The method includes providing a ring-shaped tubular blank having a hollow sealed interior, capturing the ring shaped tubular blank in a hydroforming die cavity, piercing the ring shaped tubular blank with a hollow punch, and introducing pressurized fluid through the hollow punch into the hollow sealed interior to expand the tubular structure to conform with the shape of the hydroforming die cavity and thereby hydroform the ring-shaped tubular structure.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is exemplary in nature and is not intended to limit the invention, its application, or uses.

Figure 1:
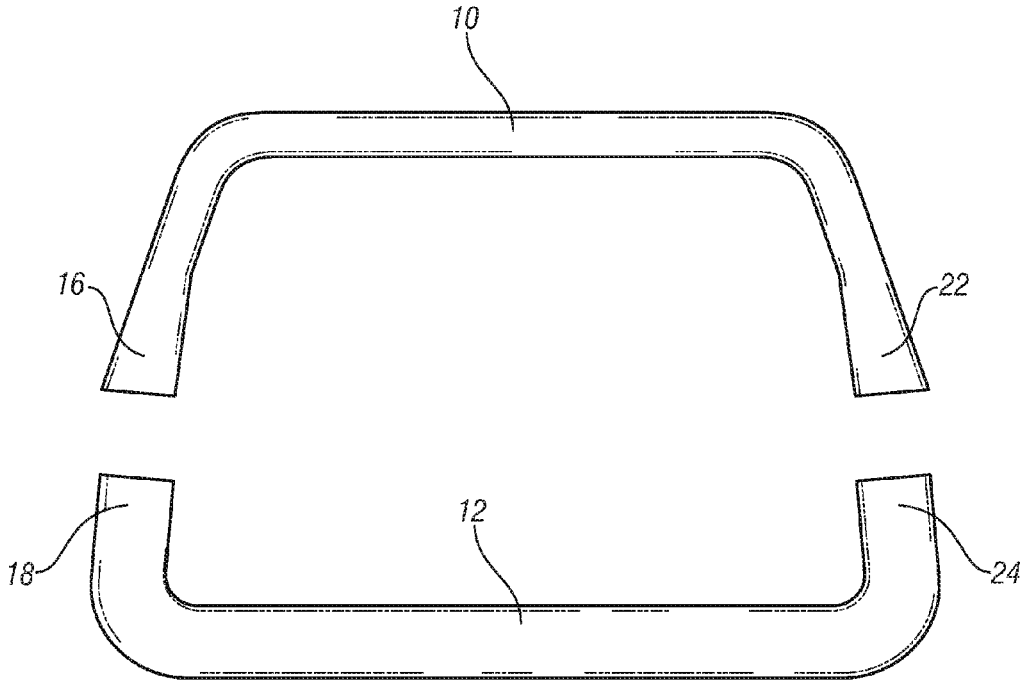
FIG. 1 is a plan view showing two tubes that have been bent into a U-shape.

Referring to FIG. 1, a first tube 10 and a second tube 12 are conventional straight lengths of tubing that have each been bent into a U-shape. The first end 16 of the first tube 10 is aligned with the first end 18 of the second tube 12. The second end 22 of the first tube 10 is aligned with the second end 24 of the second tube 12. The tubes 10 and 12 may be of round or square or oval or other cross-sectional shape. In the example of FIG. 1, the first tube 10 is round and of smaller diameter than the second tube 12, and the ends of the first tube 10 have been formed by expansion or flaring with dies so that the first end 16 and second end 22 of the first tube 10 are of the same cross sectional size and shape as the corresponding ends 18 and 24 of the second tube 12. It will be understood that the tubes 10 and 12 can be of different materials or of different wall thicknesses, if desired.

Figure 2:
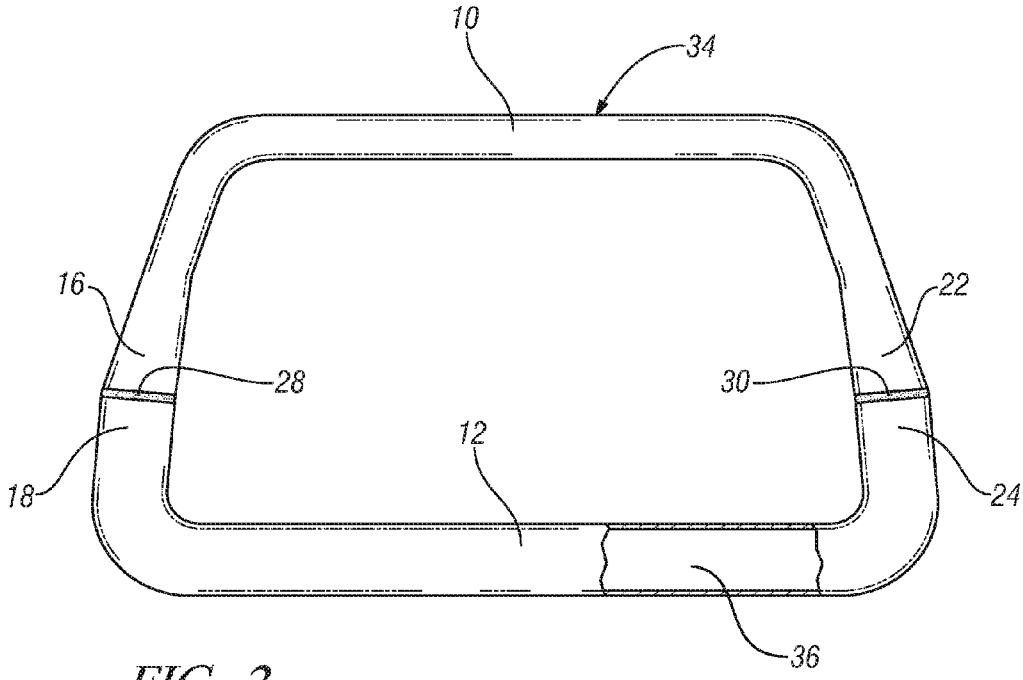
FIG. 2 is a view similar to FIG. 1 but showing the end of the two tubes welded together to form a ring-shaped tubular structure.

Referring to FIG. 2, it is seen that the tubes 10 and 12 have been aligned together end-to-end and engaged together and welds 28 and 30 have been applied so that the tubes 10 and 12 are now consolidated to form a rectangular ring-shape tubular blank, generally indicated at 34, that has a hollow sealed interior 36.

Figure 3:
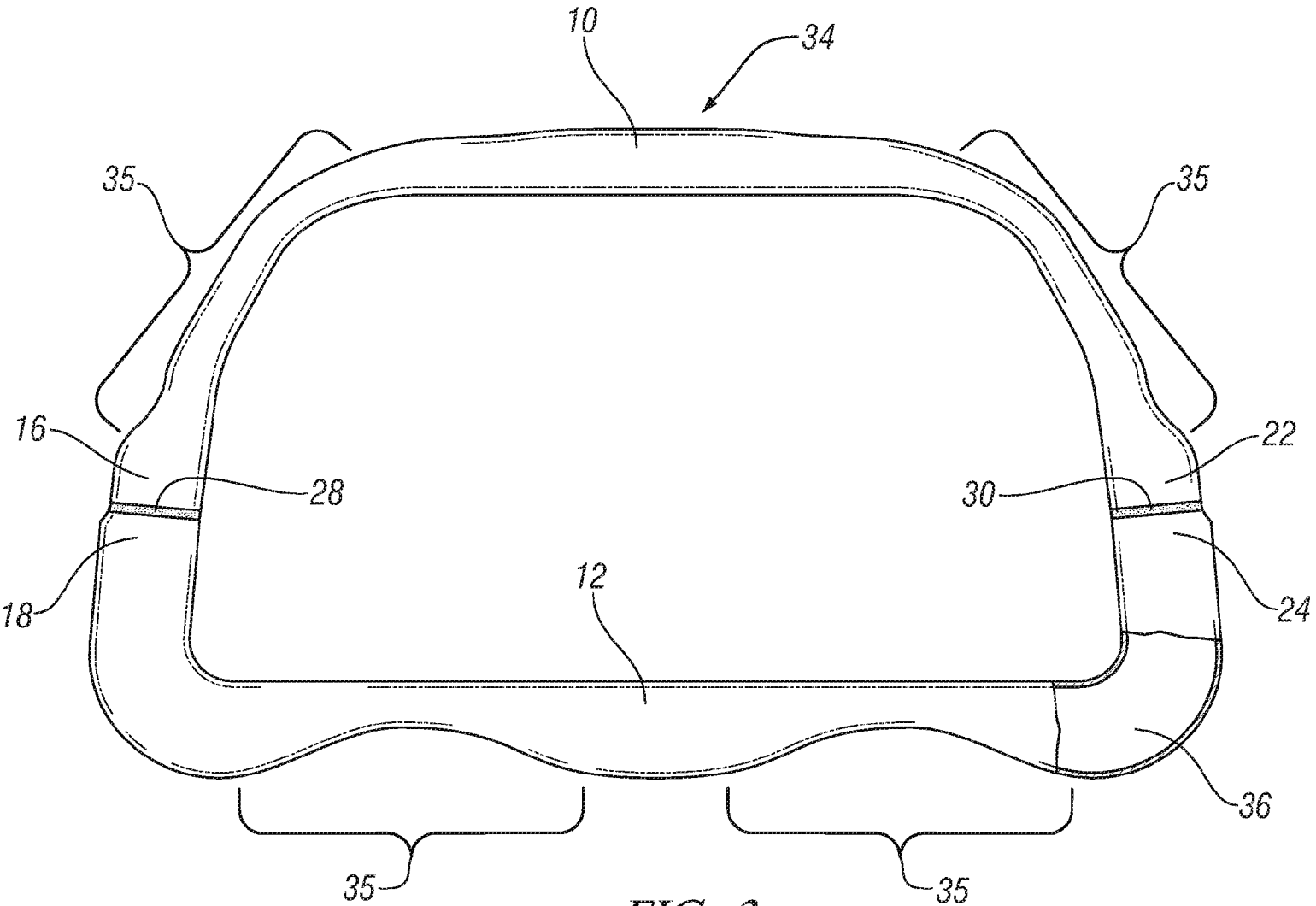
FIG. 3 is a view similar to FIGS. 1 and 2 but showing that the ring-shaped tubular structure has been crushed somewhat.

FIG. 3 shows that the ring-shaped tubular blank 34 has been pre-crushed in certain regions designated 35 so that the tubular blank 34 will fit within the cavity walls of a hydroforming die. This pre-crushing operation is performed in a pair of dies, or by tube bending rollers and is performed to modify the cross-sectional shape of the tubular blank 34 at certain preselected regions, depending upon the processing needs of a particular product and the particular tooling design for the particular ring-shaped structure that is being manufactured. In some products, this pre-crushing operation may not be needed.

Figure 4:
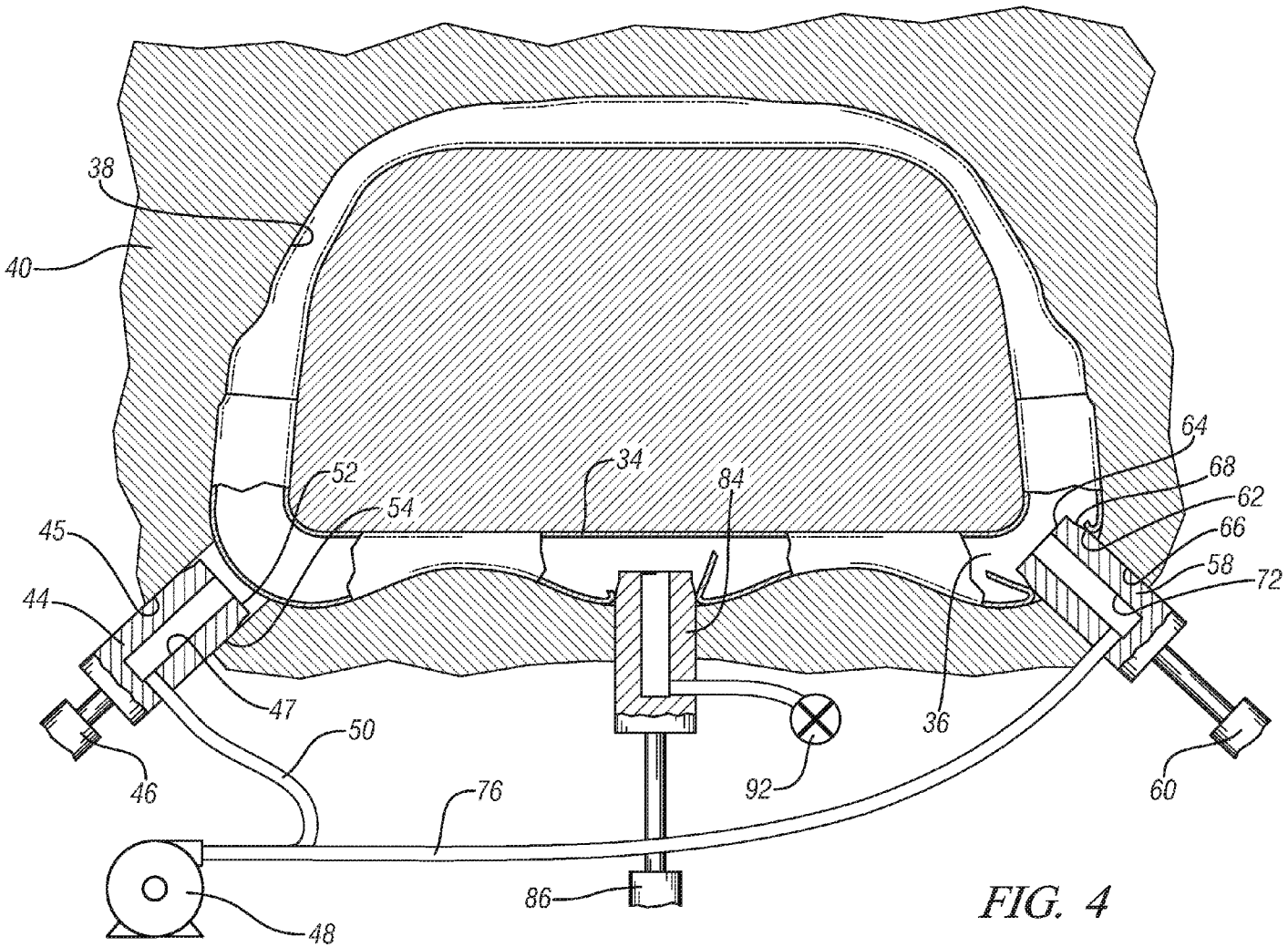
FIG. 4 is a view similar to FIG. 1 but showing that the ring-shaped-tubular structure placed within hydroforming dies and pierced by hollow punches.

FIG. 4 shows the ring-shaped tubular blank 34 captured within a die cavity 38 of a lower hydroforming die 40. An upper die, not shown, is placed atop the lower die 40 so that the ring-shaped tubular blank 34 is captured in place between the upper die and the lower die 40.

A first punch 44 is slidably mounted within a bore 45 of the lower die 40 and is actuated by a hydraulic cylinder 46 that will advance and withdraw the punch 44 within the bore 45. The punch 44 is shown in its withdrawn position away from the ring-shaped tubular structure 34. The punch 44 has a hollow 47 that is attached to a pump 48 by hoses 50. The punch 44 has a punch face 52 and an outer sealing surface 54.

Another hollow punch 58 is actuated by a hydraulic cylinder 60 and slidably mounted within a bore 66 of the lower die 40. The punch 58 is shown in its extended position in which a punch face 64 of the punch 58 has pierced through the wall of the ring-shaped tubular blank 34 to form a hole 62. The outer sealing surface 68 of the punch 58 is sealingly engaging with the walls of the ring-shaped tubular blank 34 to seal the hole 62. The punch 58 has a hollow 72 that communicates with the hollow sealed interior 36 of the ring-shaped tubular structure 34. The hollow 72 of the punch is connected to the pump 48 by a hose 76.

A third hollow punch 84 is slidably mounted within the lower die 40 and is actuated by a hydraulic cylinder 86 that will advance and withdraw the hollow punch 84. Hollow punch 84 is constructed like the hollow punches 44 and 58. The punch 84 is shown in its advanced position in which it has pierced and sealed a hole in the ring-shaped structure 34. The hollow punch 84 communicates with the hollow sealed interior 36 and is connected to an air release valve 92 or a vacuum pump.

In operation, after the ring-shaped blank 34 has been captured in the hydroforming dies, the punches 44, 58 and 84 are all advanced in order to pierce and seal holes in the walls of the ring-shaped tubular structure 34. Pressurized fluid from the pump 48 is introduced into the hollow sealed interior 36 of the ring-shaped tubular blank 34 and displaces air that is released via the air release valve 92. The fluid pressure is increased to a high level, typically in the range of 5,000 p.s.i to 25,000 p.s.i. in order to expand the walls of the ring-shaped tubular blank 34 outwardly to closely fit the shape of the cavity 38 defined by the hydroforming dies. Thereafter, the fluid is drained from the now completed ring-shaped tubular structure, the hydroforming dies are opened, and the finished part is removed from the dies.

It will be understood that the actuation of the punches to pierce and seal the holes in the ring-shaped tubular blank 34 may have a tendency to bend the walls of the ring-shaped tubular blank 34. Accordingly, as shown in FIG. 4, the punches 44 and 58 are located at the corners of the ring-shaped tubular blank 34, where the corners provide substantial resistance to bending.

Figure 5:
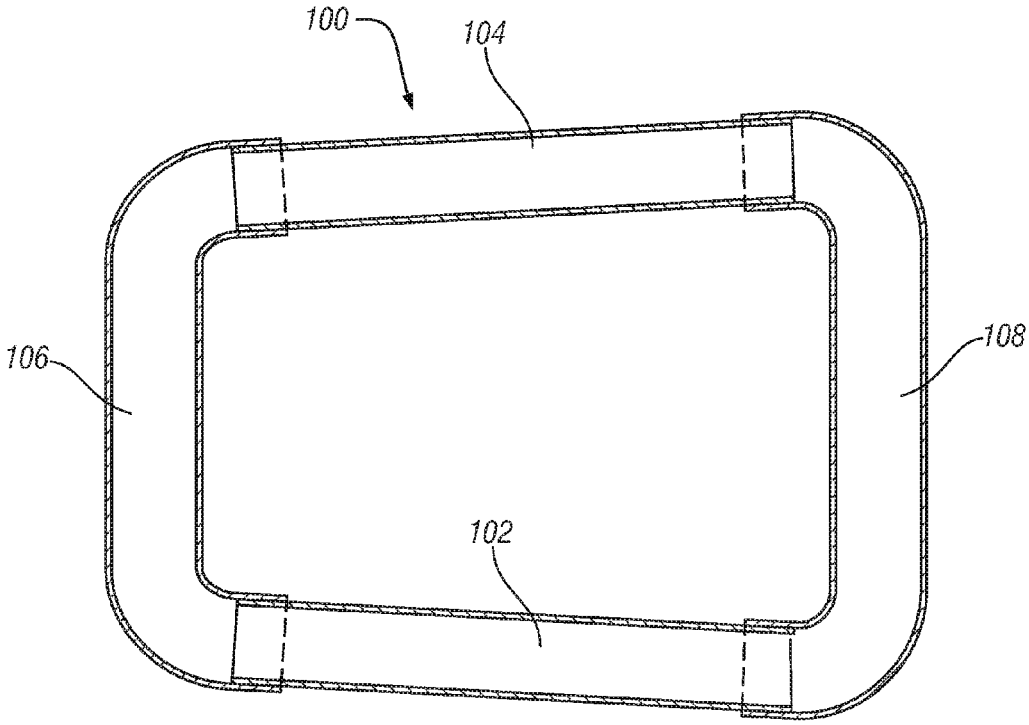
FIG. 5 is a view similar to FIG. 2 but showing four tubes joined together with lap joints to form the ring-shaped tubular structure.

Referring to FIG. 5, another embodiment is shown where the ring-shaped tubular blank 100 is assembled of four pieces of tubing, including tubes 102, 104, 106 and 108. The tubes 102 and 104 are straight lengths of tube. The tubes 106 and 108 were also straight lengths of tube but have been bent to the U-shape shown in the FIG. 5. The ends of tubes 102 and 104 are slightly smaller in diameter than the diameter of the ends of the tubes 106 and 108 so that a lap joint is formed where the tubes are slip fit together in a lap joint and then welded to form the ring-shaped tubular structure 100 that will then be placed into the hydroforming dies.

Figure 6:
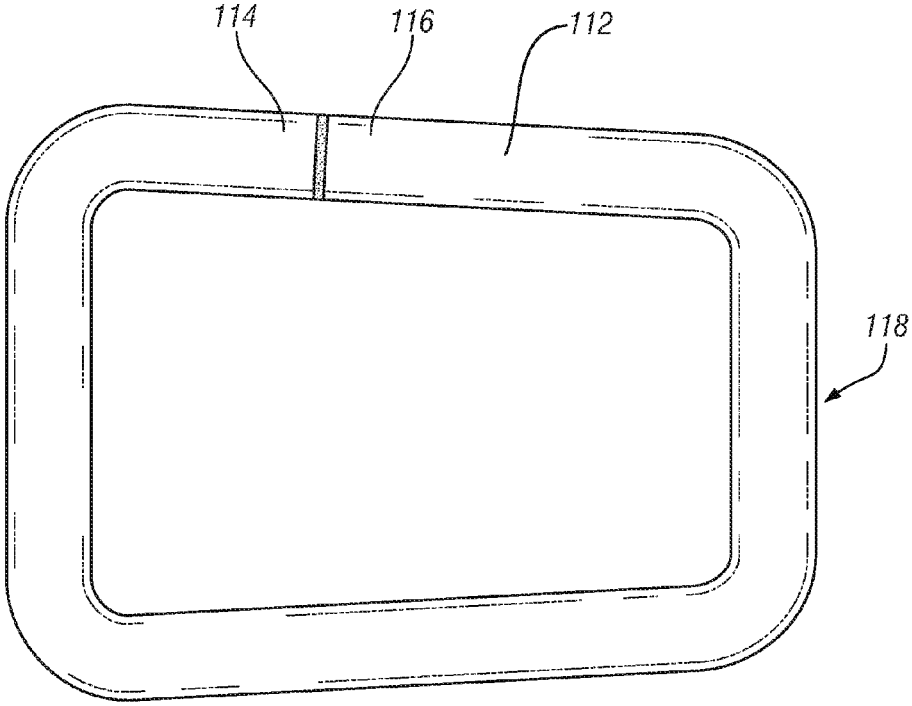
FIG. 6 is a view similar to FIG. 2 but showing a single tube bent to form a ring-shaped tubular structure.

FIG. 6 shows another embodiment in which a single length of tube 112 is bent to form a ring shape and the ends 114 and 116 of the tube 112 are then welded together to thereby form the ring-shaped tubular structure 118.

The foregoing description of the invention is merely exemplary in nature and, thus, variations thereof are intended to be within the scope of the invention. Although the drawings show the example of pre-crushing of the tube in FIG. 3, it will be understood that pre-crushing is not needed in many applications of the invention. The ring-shaped tubular structure can be assembled from any number of separate tubes that are bent and welded together, and in this way the designer is able to choose tubular sections that can vary in material, wall thickness, diameter and other characteristics. When the tube sections vary in shape or diameter, the tube ends can be flared or swaged or machined or otherwise processed to enable the tube ends to align and match each other in cross-sectional size and shape in readiness for welding together to form a continuous and sealed ring-shaped tubular structure ready for capture within the hydroforming dies. A lap joint condition, butt joint condition or combination of these conditions can be used to create a compound blank. Alternatively, tubes can be joined using adhesives.

Furthermore, it will be appreciated that any desired number of punches can be employed for the release of air and the introduction of the pressurized fluid. The particular example of pump, hoses, and air release valve shown in the drawing is only one example a system for performing the hydroforming. For example, a single punch might be employed, and first connected to a vacuum source to evacuate the air from the interior of the ring shaped tubular structure, and then connected to the source of pressurized fluid, and then connected to a drain for draining the fluid.

What is claimed is:

1. A method of hydroforming a ring-shaped tubular structure comprising:

providing a ring-shaped tubular blank having a hollow sealed interior;

capturing the ring-shaped tubular blank in a hydroforming die cavity;

piercing the ring-shaped tubular blank with a hollow punch;

and introducing pressurized fluid through the hollow punch into the hollow sealed interior to expand the tubular blank to conform with the shape of the hydroforming die cavity and thereby hydroform the ring-shaped tubular structure.

2. The method of claim 1 further comprising providing said ring-shaped tubular blank by providing a plurality of straight tubes and bending one or more of the tubes so that the ends of the plurality of tubes align end-to-end to form the ring shape and then welding the aligned ends together.

3. The method of claim 2 further comprising at least one of the plurality of straight tubes having a diameter that is different from the other of the tubes and flaring the ends of the smaller diameter tube to match the diameter of the other of the tubes.

4. The method of claim 2 further comprising at least one of the plurality of straight tubes having a diameter that is different from the diameter of the other tubes and then inserting the smaller diameter tube ends into the larger diameter tube ends and welding the tubes together.

5. The method of claim 1 further comprising providing said ring shaped tubular blank by providing a single straight tube and bending the tube to the ring shape and welding the ends together to provide the hollow sealed interior.

6. The method of claim 1 further comprising pre-crushing the ring-shaped blank so that the ring-shaped blank fits into the hydroforming dies.

7. The method of claim 1 further comprising piercing the ring-shaped tubular blank with a plurality of hollow punches for introducing pressurized fluid.

8. The method of claim 1 further comprising piercing the ring-shaped tubular blank with a hollow punch through which air is released to allow the hollow sealed interior of the ring-shaped tubular structure to fill with the pressurized fluid.

9. The method of claim 8 further comprising said hollow punch being connected to a vacuum source to evacuate air from the hollow sealed interior of the ring-shaped blank.

10. The method of claim 1 further comprising piercing the ring-shaped tubular blank with at least one hollow punch introducing pressurized fluid into the hollow sealed interior of the ring-shape tubular blank and at least one hollow punch releasing air from the sealed interior of the ring-shaped tubular blank.

11. The method of claim 1 further comprising the ring-shaped tubular blank being generally rectangular in shape with corners and the hollow punch pierces the ring-shaped tubular blank at a corner.

12. A method of hydroforming a ring-shaped tubular structure comprising:

providing a first tube having a first end and a second end, and a second tube having a first end and a second end;

bending at least one of the tubes so that the first ends of the tubes are aligned with each other and the second ends of the tubes are aligned with each other;

joining the first ends of the tubes together and joining the second ends of the tube together to thereby form a ring-shaped continuous tubular structure having a hollow sealed interior;

capturing the tubular structure in a hydroforming die cavity;

piercing the tubular structure with a first hollow punch and releasing air from the hollow sealed interior through the first hollow punch;

and piercing the tubular structure with a second hollow punch and introducing pressurized fluid through the second hollow punch to expand the tubular structure to conform with the shape of the hydroforming die cavity.

13. The method of claim 12 further comprising the ring-shaped tubular structure being generally rectangular in shape with corners and at least one of the hollow punch pierces the ring-shaped tubular structure at a corner.

14. A method of hydroforming a ring-shaped tubular structure comprising:

providing a ring-shaped tubular blank having a hollow sealed interior;

capturing the ring-shaped tubular blank in a hydroforming die cavity;

piercing at least one hole in the ring-shaped tubular blank into the hollow sealed interior and releasing air from the hollow sealed interior and introducing pressurized fluid into the hollow sealed interior to expand the ring-shaped tubular blank to conform with the shape of the hydroforming die cavity and thereby hydroform the ring-shaped tubular structure.

15. The method of claim 14 further comprising piercing the at least one hole via at least one hollow punch that is slidable in the hydroforming die.

16. The method of claim 15 further comprising a hydraulic cylinder for advancing the at least one hollow punch to pierce the hole.

17. The method of claim 15 further comprising the hollow punch having a sealing portion that seals the hole pierced into the ring-shaped tubular blank and the hollow punch being connected a source of pressurized fluid.

18. The method of claim 14 further comprising at least one hollow punch advanced by a hydraulic cylinder to pierce a hole in the ring-shaped tubular blank and having a sealing portion that seals the hole, said hollow punch being connected to a source of pressurized fluid.

* * * * *